US011083278B2

(12) United States Patent
Villaruz

(10) Patent No.: US 11,083,278 B2
(45) Date of Patent: Aug. 10, 2021

(54) INCLEMENT WEATHER MULTI-MODE HIKING GARMENT

(71) Applicant: Adrian S. Villaruz, Sequim, WA (US)

(72) Inventor: Adrian S. Villaruz, Sequim, WA (US)

( * ) Notice: Subject to any disclaimer, the term of this patent is extended or adjusted under 35 U.S.C. 154(b) by 245 days.

(21) Appl. No.: 16/269,281

(22) Filed: Feb. 6, 2019

(65) Prior Publication Data

US 2019/0298041 A1 Oct. 3, 2019

Related U.S. Application Data

(60) Provisional application No. 62/648,728, filed on Mar. 27, 2018.

(51) Int. Cl.

| | |
|---|---|
| ***A45F 4/02*** | (2006.01) |
| ***A41D 3/04*** | (2006.01) |
| ***A41D 15/04*** | (2006.01) |
| *A45F 4/00* | (2006.01) |

(52) U.S. Cl.

CPC ..... *A45F 4/02* (2013.01); *A41D 3/04* (2013.01); *A41D 15/04* (2013.01); *A45F 2004/006* (2013.01)

(58) Field of Classification Search

CPC ..... A45F 4/02; A45F 2004/006; A41D 3/04; A41D 3/05; A41D 3/08

USPC ..... 2/78, 87

See application file for complete search history.

(56) References Cited

U.S. PATENT DOCUMENTS 4,064,562 A * 12/1977 Kenny ..... A42B 1/046 2/84

4,078,264 A * 3/1978 DeGennaro ..... A41D 3/08 2/88

6,751,806 B2 * 6/2004 Hinnant ..... A41D 3/02 2/108

2011/0179548 A1 * 7/2011 Weston ..... A41D 3/08 2/84

2013/0318679 A1 * 12/2013 Esquer ..... A41D 3/08 2/84

(Continued)

OTHER PUBLICATIONS

GoreTex Jackets found online at: https://www.llbean.com/llb/shop/117818?page=l-l-bean-north-col-gore-tex-pro-jacket&bc=12-26-593-504714-506675&feat=506675-GN3&csp=f.

(Continued)

*Primary Examiner* — Timothy K Trieu

(74) *Attorney, Agent, or Firm* — Innovation Law Group Ltd.; Jacques M. Dulin, Esq

(57) ABSTRACT

Hiking/trekking garment employing a special suspension harness and bat-wing type sleeves configured to permit the garment to be partially doffed in a gathered transport mode yet is retained on the hiker's back for rapid deployment in case of unexpected change in the weather. The backpack and garment may be donned or doffed independent of the other and without assistance of another person. The harness prevents the garment from riding up and back to not choke the wearer. The garment is specially configured with expandable backpack cover panels. A backpack may be donned or doffed by the wearer alone without assistance and independent of the garment, even while the garment is deployed in the inclement weather use position. Conversely, the garment can be independently put on or taken off without disturbing the backpack and without assistance. The length of the garment may be selected to form a cloak or a jacket.

19 Claims, 15 Drawing Sheets

(56) References Cited

U.S. PATENT DOCUMENTS

2016/0236110 A1* 8/2016 Tanous ..... A63H 13/04

OTHER PUBLICATIONS

Mens Jackets, vests found online: https://www.outdoorresearch.com/us/en/mens/mens-jackets-vests/mens-hard-shells/mens-interstellar-jacket/p/2644191292008.
Rain gear and jackets found on Amazon: https://smile.amazon.com/gp/product/B019GZ1KSK/ref=ppx_yo_dt_b_asin_title_o00__o00_s00?ie=UTF8&psc=1.
Triwonder backpack raincoat outdoor camoflage found online: https://smile.amazon.com/TRIWONDER-Backpack-Raincoat-Outdoor-Camouflage/dp/B01CBGPXR0/ref=sr_1_5?ie=UTF8&qid=1550508258&sr=8-5&keywords=raincoat+with+backpack+cover.

* cited by examiner 10
18
18b
18R
18a
14L
D
18d
18eR
C
21
B
44R
58
36Z
E
45
A
38
14R
15R
46
16R
56
54
31
24R
38
30R
16R
12R
18
10
18b
18R
14L
18a
D
18d
18eR
21
C
44R
B
45
36Z
E
58
52
15R
A
38
14R
46
16R
56
54
16L
24R
16R
30R
12R

INCLEMENT WEATHER MULTI-MODE HIKING GARMENT

CROSS-REFERENCE TO RELATED APPLICATION

This is the Regular Application of the priority Provisional Application Ser. No. 62/648,728 filed Mar. 27, 2018 of the same title by the same inventor, the priority benefit of the filing date of which is claimed under 35 USC 119 ff.

FIELD

This invention relates to hiking garments, and more particularly to hiking or trekking cloaks and jackets that employ a special harness and sleeves that prevent the cloak from riding up and back and permit the wearer to free his/her arms and shoulders for fair weather use. In addition, the garments are optionally specially configured to cover a back-pack. The inventive garments include fittings, zippers, closures and belt assemblies to permit the cloak or jacket to be partially doffed in a gathered transport mode which uncovers the wearer, yet is retained on the user's back so that the garment may be rapidly deployed to cover the wearer in case of a rapid and unexpected change in the weather. The backpack may be donned or doffed by the wearer alone without assistance as well as independent of the garment, that is, a backpack can be put on or taken off (extracted) from under the cloak while the cloak is deployed in the inclement weather use position. Conversely, the cloak can be independently put on or taken off without disturbing the backpack and without assistance by another person.

BACKGROUND

Hikers ordinarily carry backpacker or emergency rain ponchos to cover themselves while back-country hiking when there are rapid and unexpected changes in the weather, such as rain or snow squalls, or as they traverse higher ground and move into changed micro-climates. Such ponchos are usually selected for light weight and may be made of plastic sheeting or nylon.

While the plastic-sheeting ponchos may be rain-resistant or rain-proof, such ponchos typically do not breathe. As a result, they cause the wearer to sweat in warm or sunny weather or during extended exertion. In short they are extremely uncomfortable. Plastic ponchos are typically not robust, being very light-weight, are prone to rip or tear, and are considered only to be temporary and disposable. Nylon ponchos, unless treated, may be suitable for mist but not for full rain or downpours; that is, they are light duty, rain-resistant but not rain-proof. PVC-coated nylon ponchos likewise do not breathe and are much heavier than the light plastic variety. Such ponchos are offered in various designs, including sleeveless designs in order to double as tents, or with sleeves.

All these ponchos come with attached or detachable hoods. One problem with the poncho design is that they are formless, being only great rectangular sheets having a hood attached to a central neck-hole. The sheets are large in order to accommodate a wide range of body types and heights, and to be big enough to cover a backpack of undetermined dimension. That over-size design approach results in excess fabric or plastic, and additional weight. The plastic can also be noisy, poorly wear resistant, and generate static electricity which causes dirt dust, mildew, mold, and leaf material to adhere to it. They are often also used as ground cloths to prevent upward migration of moisture.

A serious problem with the neck-hole is that they are usually small in order to satisfy the "one size fits all" requirements. Thus, putting-on or taking off (doffing) the typical poncho requires a struggle to fit over the head or extract your head once the poncho is on. This means the poncho cannot be easily donned or doffed. In addition, a tight neck hole produces chafing and choking, especially when worn over a backpack. The backpack tends to pull the poncho backward, choking the wearer. This is exacerbated if the trailing fabric or plastic catches on a branch or rock, or becomes heavy when saturated with water.

Finally, the currently available, conventional poncho, parka and rain gear garments are stored in or on a backpack when not in use. As a result, when the weather turns bad, the hiker must stop, doff his/her backpack, unpack the poncho from the backpack in the rain, cold or snow, and either don and extend the poncho over a backpack that has been put back on, or try to don the backpack over the poncho after it has been put back on. It is extremely difficult for a lone hiker to try to drag a poncho over a backpack being worn. That can result in rips in the poncho, or bunching at the neck, with the waist and back of the hiker exposed.

Accordingly, there is an unmet need in the art to provide a multi-mode hiking garment that is specially configured to cover a backpack, that is easy to don and doff by a wearer without assistance from others, that can be moved (furled) and gathered to a carry position on the back of the user in which the wearer is uncovered as needed to accommodate for warm weather, yet is easy to don (unfurl) in case of rapid change of weather, and that is fitted with a special suspension strap harness that prevents the inventive hiking garment from riding up in the front and choking the wearer, yet permitting independent donning and doffing of the backpack from under the cloak, that is, extracting the backpack from under the fully deployed cloak during inclement weather.

THE INVENTION

The inventive Inclement Weather Multi-Mode Hiking Garment, the length of which can be selected to produce a cloak or jacket depending on the length, includes a suspension strap harness system that permits the active user (hereafter "hiker") to independently don and doff a backpack, whether the garment is in either the fully deployed, inclement weather wearing configuration, or while the garment is partially doffed in a gathered transport or carry configuration, on the back of the user. The user can don and doff the inventive garment by him/herself, that is, without the need of assistance of a second person. Also, the inventive cloak, independently of whether the hiker has already donned a backpack, may be donned or doffed. Conversely, a backpack may be donned or doffed independent of the garment, that is, it can be put-on or taken-off (extracted) from under the garment, while the garment is fully deployed in the inclement weather use position. And the hiker can do it alone, without assistance. The inventive garment can be used with or without a back pack.

It is an important feature of the inventive garment and its retaining suspension system that it may be deployed in a fully unfurled configuration, such as in the rain, yet a backpack may be donned, or put on, the hiker's back while the garment is not disturbed, with the result that the backpack will be covered under the garment. The inventive garment includes drawstrings, belting, buckles and sleeves which permit the hiker, while wearing a backpack, to gather the garment (furling it), while being worn, below the bottom of the backpack into a transport position. Thus, the inventive garment is still carried yet does not hinder the arms and legs of the hiker and can be deployed rapidly (unfurled) if inclement weather, such as a freshet or colder weather, arrives during the activity. The inventive garment can be moved (furled) and gathered to a carry position on the back of the user in which the wearer is uncovered as needed to accommodate for warm weather, yet is easy to don (unfurl) in case of rapid change of weather In short, the garment is always ready at hand.

The inventive garment comprises broadly two main parts:

A. an assembly of fabric panels that when sewn (or otherwise fastened) together cooperate to form a garment having batwing-type sleeves and optionally a hood assembly, a suspension strap panel secured to the inner back of a yoke panel forming a channel through which a suspension strap is threaded, and an optional back pouch (compartment) that is selectively expandable to cover a backpack (preferably for the cloak configuration, and only a small compartment or none, for a jacket configuration); and B. a suspension harness system that includes a continuous suspension strap to suspend the garment just below the collar via the suspension strap panel, the strap being wrapped over the shoulders, directed under the arms, thence criss-crossed across the back and brought to the front where it is clipped to engage the abdomen.

The suspension harness system prevents the garment being pulled back by the weight of the garment and/or backpack, upward into the Adams's apple and throat, in which position it would choke the wearer. The length of the front and back panels may be selected for length which determines whether the inventive garment is a full cloak, or a short jacket.

The batwing sleeves permit ease of donning and doffing the garment without assistance by another person, and to withdraw the arms while the garment is donned, to adjust the harness and straps of the backpack. In addition, chest and/or armpit zippers can be opened (unzipped) to provide a vent to prevent overheating and control sweating. These vents also can permit extension of arm(s) from inside the garment while it is zipped in the front. This permits free use of hands and arms while the hiker's body and backpack are still covered.

In addition, in an exemplary embodiment the garment includes: an internal waist channel that contains a draw cord; hip pockets with waterproof zippers; a retaining buckle assembly; external chest pocket(s) and/or hand pockets; closures such as Velcro-type fasteners or snaps to configure the sleeve cuff opening size; interior chest or waist pockets; and a pouch secured adjacent the yoke panel into which the suspension harness straps may be stowed when not in use.

One skilled in the art will readily appreciate that the garment may be provided with a wide variety of configuring and retaining pockets, snaps, Velcro-type hook and loop fasteners, zippers, fabric and leather loops, D-rings and the like, in suitably accessible positions, and with appropriate seals, such as waterproof closures. Likewise, one skilled in the garment construction trade will understand that various types of stitches may be used to form seams, pockets, reinforcing, cord retaining channels, strap-retaining loops and channels and the like, which are straight-forward so that stitching details need not be described. Likewise, a fabric cutting layout of the various panels or pieces is not shown as that is a straight-forward exercise that depends in large part on the width of the fabric selected from which the garment panels are to be cut.

BRIEF DESCRIPTION OF THE DRAWINGS

The invention is described in more detail with reference to the annotated drawings, in which:

FIGS. 1A-1C are a set of front and side views of the inventive garment as seen from the exterior, in which FIG. 1*a* is a front elevation of the garment closed and flat with panels identified; FIG. 1B is an elevation view from the right side showing the backpack pouch open (deployed) to cover a backpack; and FIG. 1C is a elevation view from the right side showing the deployed backpack pouch cinched under the bottom of a backpack, the inventive garment now being gathered at the back in the inclement weather hiking configuration, such as cold, rain or snow;

FIGS. 6A-6C are a series of side elevation views of the inventive garment in its several modes of use, in which FIG. 6A shows the garment fully furled and carried on the back of a user without a backpack during fair weather conditions; FIG. 6B shows the garment backpack pouch deployed over a backpack being carried by a user; in this configuration the garment is not unfurled to cover the user's shoulders and chest; and FIG. 6C shows the configuration of FIG. 6B in which the backpack pouch is cinched below the bottom of the backpack and the gathering buckles engaged to gather the material, thereby reducing the size of the garment "tail";

FIGS. 9A and 9B are rear right side isometric views showing the inventive garment in the fully deployed configuration for inclement weather, wherein FIG. 9A shows the backpack pouch assembly unfurled and deployed to cover a backpack, and FIG. 9B shows the backpack pouch lower portion cinched under the bottom of the backpack for hiking, but the garment is not gathered;

FIGS. 10A and 10B are right side isometric views showing the transition of the backpack pouch from the partially open position to the closed position, in which FIG. 10A shows the top zippers have been unzipped to release the infolded backpack pouch material (or the reverse, the tucking-in of the material in preparation to closure of the zippers), and FIG. 10B shows the pouch completely stowed and the top zippers closed;

FIG. 14A-B-C are three views of a jacket-style garment constructed in accord with the principles of the invention, in which FIG. 14A is a front elevation view of the jacket closed showing the bat-wing sleeves extended laterally and the externally accessible pockets; FIG. 14B is a side elevation of the closed jacket.

DETAILED DESCRIPTION OF THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention. One feature may be shown in one drawing, and another feature is better shown in another drawing.

Figure 1A:
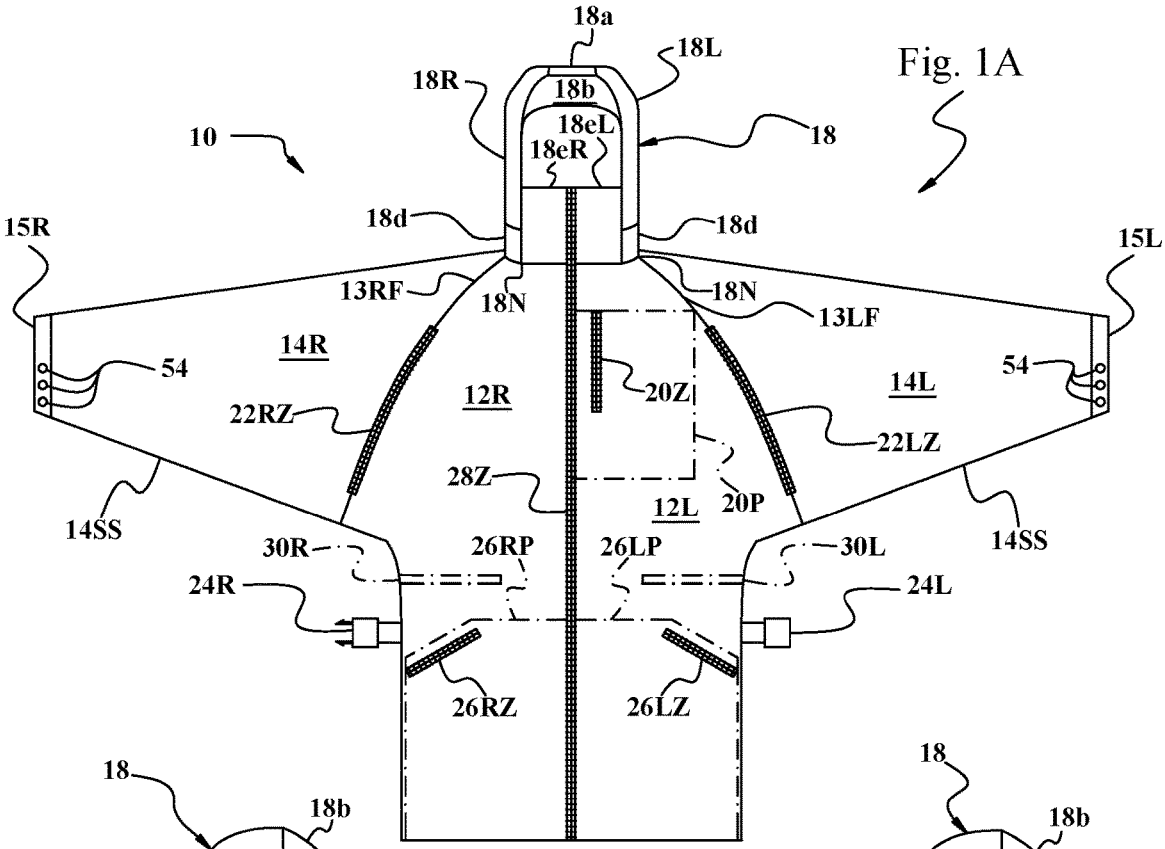
Figure 1B:
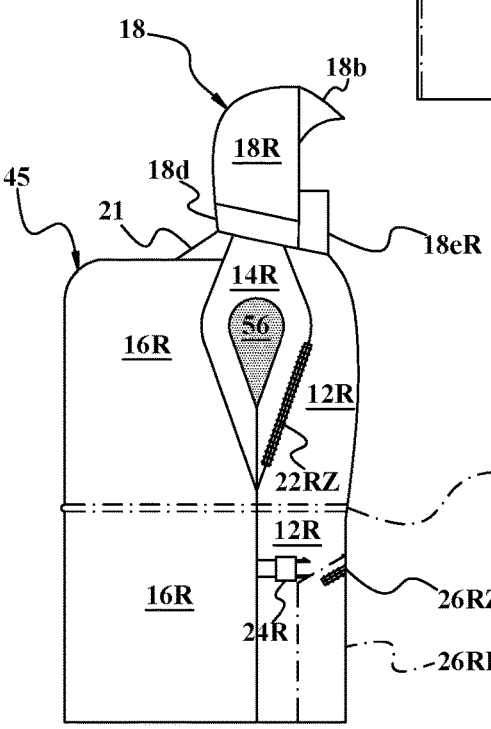
Figure 1C:
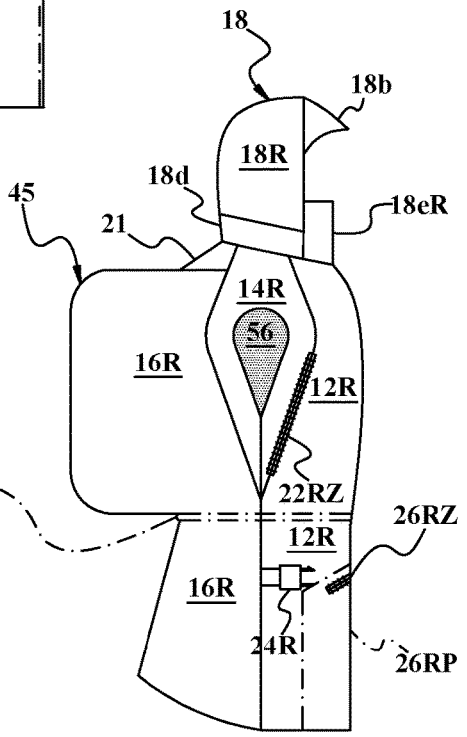
Figure 4:
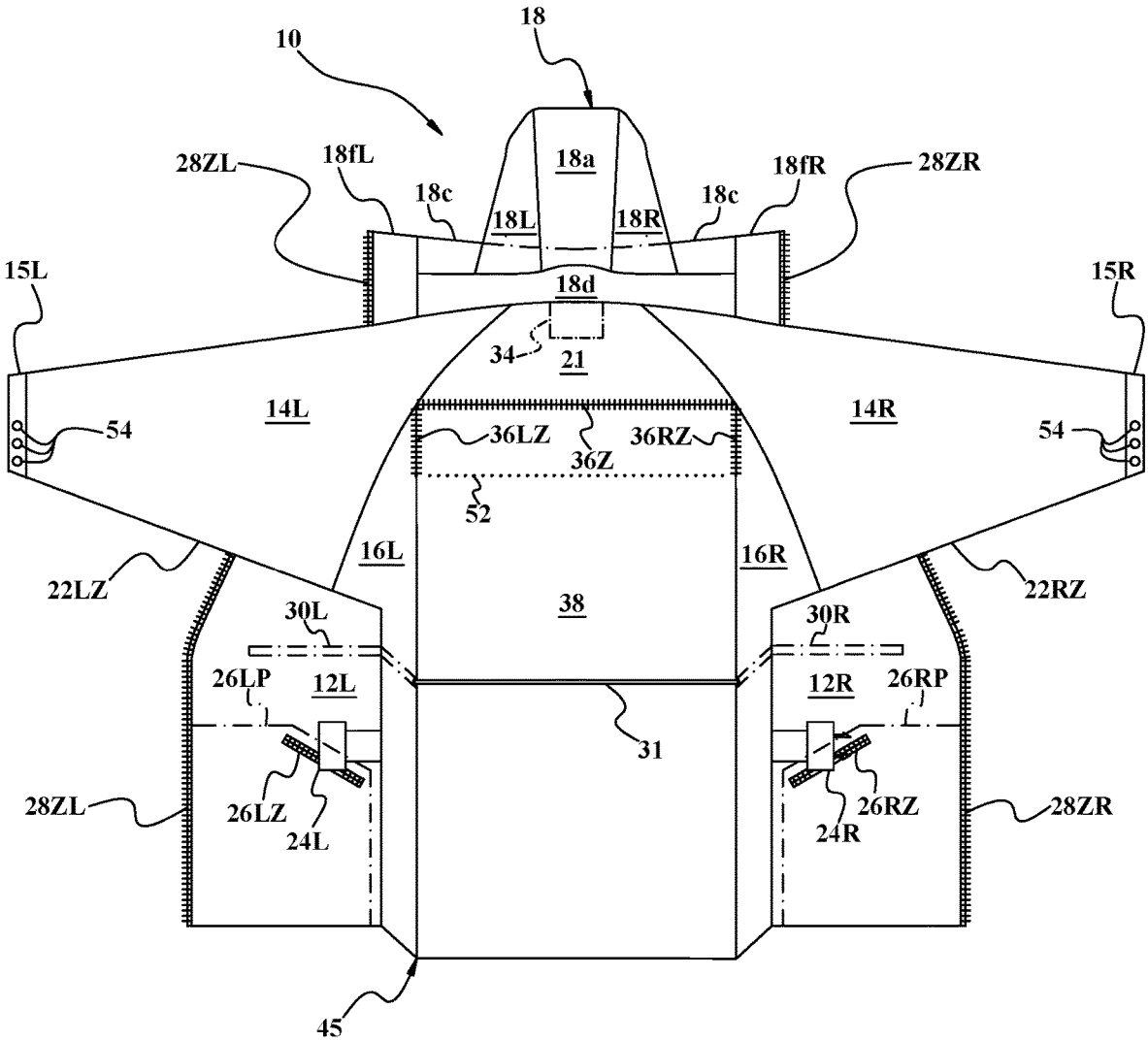
FIG. 4 is a rear exterior elevation view of the inventive garment opened and lying flat showing the backpack cover in its fully deployed position with the pouch zippers unzipped.
Figure 5:
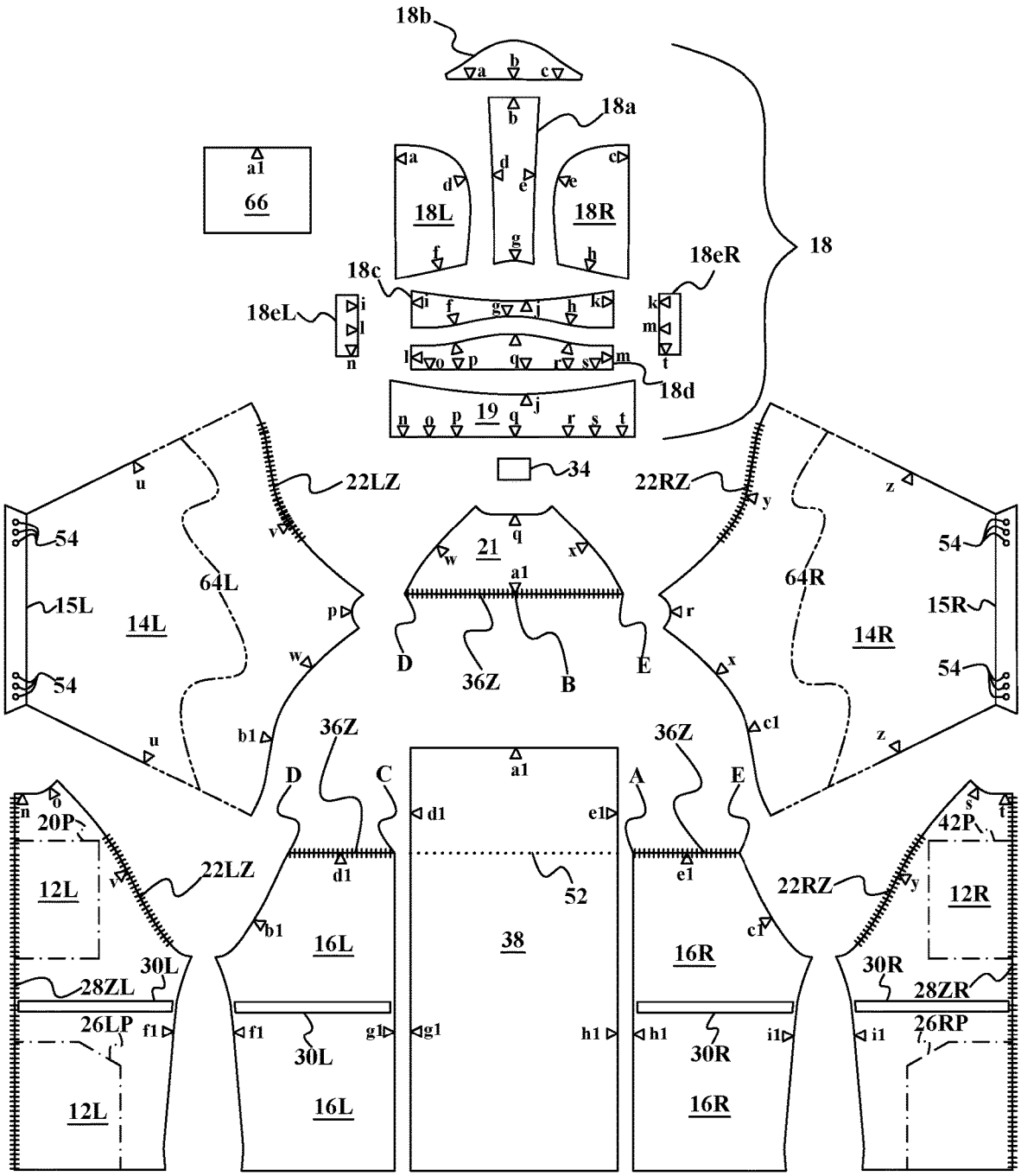
FIG. 5 is an exploded plan view of the several individual panels or pieces of the inventive garment as seen from the exterior side, laid out flat in standard construction layout with marginal "notches" (A) lettered a, b, . . . to z, to show how mating panels cooperate to fit together to make up the garment, the small triangular notches being the standard convention for indicating mating margins to form seams between the adjacent panels as shown, and the capital letters A-E identifying the mating zipper end points.

FIGS. 1A-1C are a set of front and side views of the inventive garment 10, in which FIG. 1*a* is a front elevation of the garment shown flat and closed by front zipper 28Z, which has left and right seam sections, 28ZL, 28ZR (seen in FIG. 5). The garment 10 comprises several panels, which are individually shown in an exploded pattern view of FIG. 5, which should be consulted while viewing FIGS. 1-4. The front of the garment 10 is formed from mirror image front left and right front panels 12L and 12R respectively. Each includes a waterproof zipper-closeable hip pocket 26LP and 26RP (not shown in FIG. 4). The panel 12L also includes a waterproof zipper-closeable chest pocket 20 (not shown in FIG. 4).

The respective front panels 12L, 12R are joined, in this embodiment, to batwing style raglan sleeves 14L and 14R along left side seam 13LF and right side seam 13RF. As seen in FIG. 1, the left front panel 12L diagonal margin is joined to the curved diagonal margin of sleeve panel 14L along the mating seam contour 13LF. Likewise the right front panel 12R is joined to sleeve panel 14R along mating seam contour 13RF. Disposed in a portion of these sleeve seams are chest vent zippers 22RZ and 22LZ, respectively, which selectively may be opened by the user to permit venting excess heat and moisture at the right and left sides of the user's chest, or to be closed to retain heat as climate conditions dictate. The sleeves 14L/14R are joined along seam line 14SS for the full length of the sleeve to the cuff band 15L and 15R, respectively. When the garment is donned, unzipping the chest-side zippers 22LZ and 22RZ provide ventilation or/and permit the user to withdraw his/her arms to assist with doffing the garment. That is, the arms can be pulled-in (retracted) from the sleeves, freed via the opened chest-side zippers (or the alternate armpit zippers, see FIG. 15) and extended exterior of the garment. The closures 54 (snaps are shown) adjacent the cuff 15L, 15R permit selectively sizing the cuff opening from small to medium to large, so that the hands can be withdrawn even when the hiker is wearing gloves.

The hood assembly 18 comprises a pair of generally D-shaped side panels 18L, 18R that are joined together at their respective arcuate back margins to top/back head panel 18*a*. All three of these panels are joined along the front top margin with a generally triangular panel to form a bill 18*b*. The bottom of the hood panels 18L, 18R and 18*a* are joined to the neck margins 18N of the sleeves 14L/14R and the upper back panel 21.

The straps of garment retaining waist buckle set 24L, 24R are sewn into the seams that join the front panels 12L, 12R to their corresponding side panels 16L, 16R, as seen in FIGS. 1*b*, 1*c* and 5, which will be described in more detail below.

FIG. 1B is an elevation view from the right side, that is the wearer facing right, showing the side panels 16R (16L would be visible if the wearer were facing left) fully extended, that is the backpack pouch 45 is open (deployed) to cover a backpack. An interior cinch cord channel 30L/30R is shown in dashed lines. Note the hand hole 56, shown as an inverted tear drop shape, is shown in the largest opening configuration. By utilizing the spaced array of snaps (or Velcro strips) FIGS. 1A and 5 show that the hand-hole size can be reduced for snug fit around the wrist. FIG. 1C is an elevation view as in FIG. 1B, also from the right side showing the deployed backpack pouch gathered under the bottom of a backpack by means of an elastic cinch cord threaded through internal channel 30L/30R. FIG. 1C shows the inventive garment now configured for an efficient hiking configuration, in which the excess garment material below the backpack is no longer open to flop with each stride.

Figure 2A:
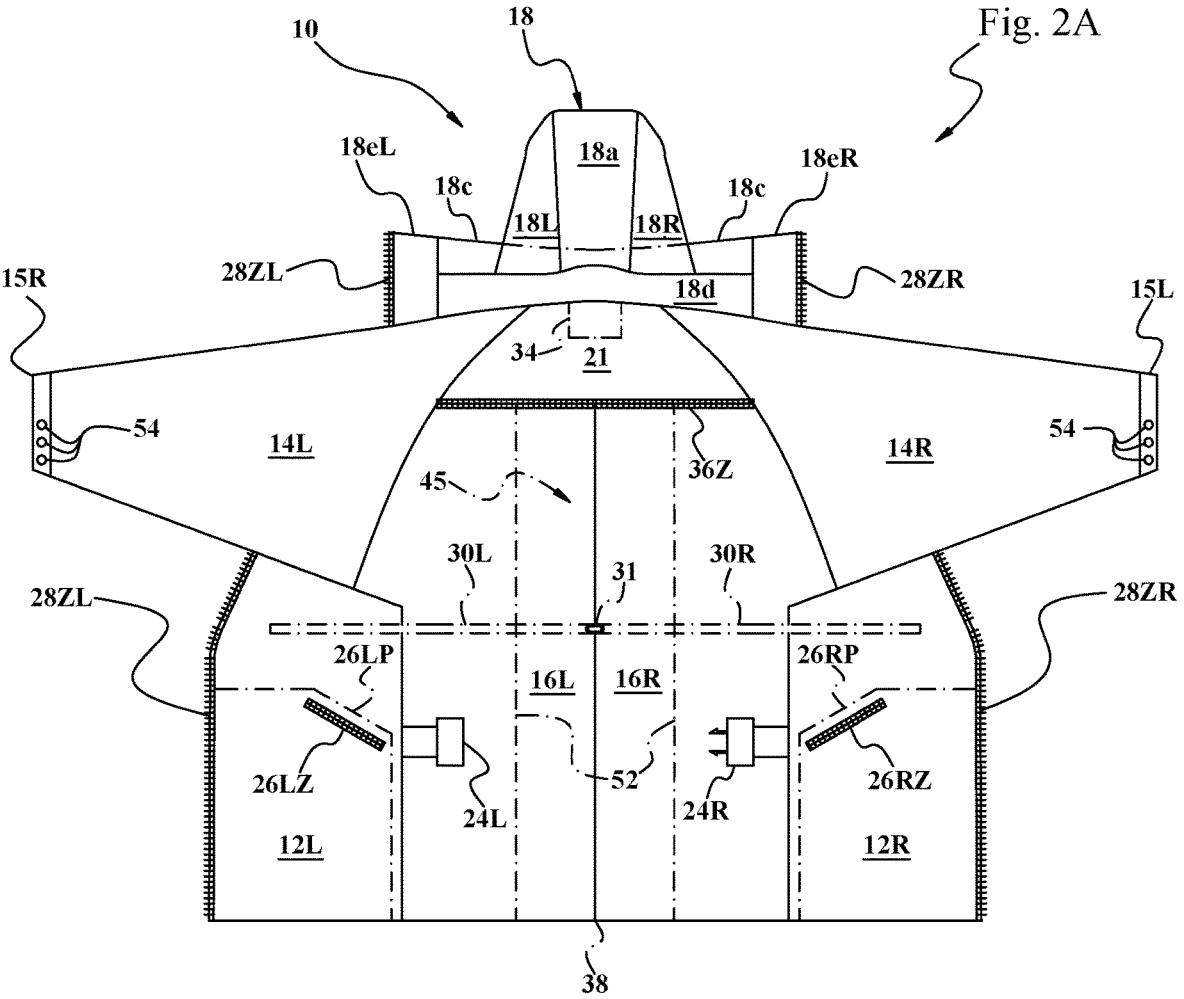
FIG. 2A is a rear external elevation view of the inventive garment lying flat in which the backpack pouch panels are zipped closed, and the front and collar panels are unzipped to the opened configuration.
Figure 3:
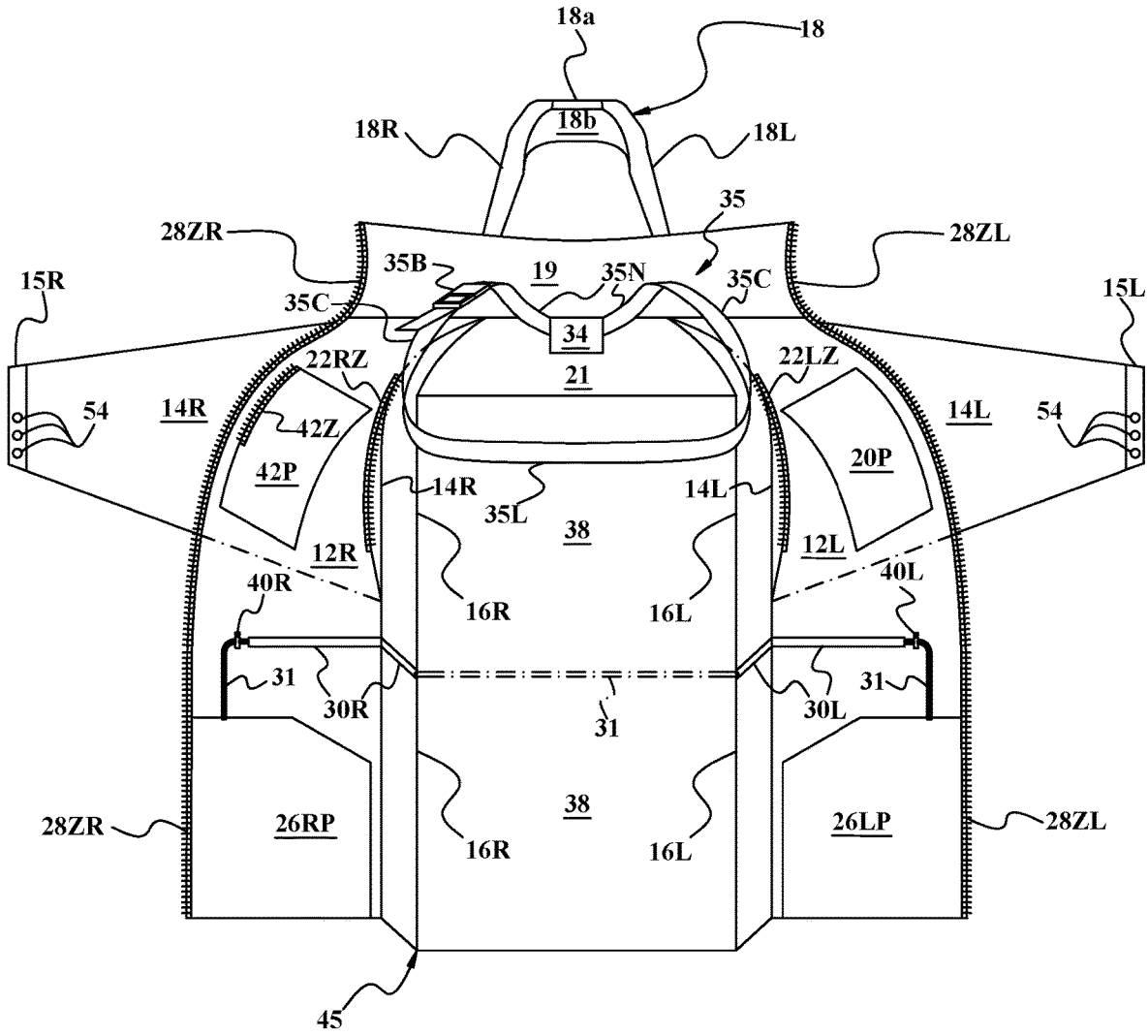
FIG. 3 is a front interior elevation view of the inventive garment opened and lying flat showing the cooperating panels and the garment suspension harness strap in the wear position; this is the obverse side of the FIG. 2 view.

FIG. 2A is a rear elevation exterior view of the inventive garment 10 lying flat in which the backpack pouch (main compartment) 45 is zipped closed at the top by waterproof zipper 36Z which joins the upper margins of outer back pack panels 16L, 16R via intermediary collar back panel 18*d* (exterior), 19 (interior) to the shoulder yoke panel 21. When outer back panels 16L, 16R are unzipped, the inner pouch panel 38 (hidden in this view) expands out and backward to form the pouch. That is, the outer back panels form the sides of the pouch 45 as best seen in FIGS. 1B, 1C, while the inner pouch panel expands to become the outer cover for the back pack (as seen in FIG. 3). The dotted/dashed lines 52 show the interior folding of panel 38 underneath the panels 16L and 16R and 38. The hood structure 18 is also shown, with panel 18*a* forming the top/back head panel, the left and right D-shaped panels 18L, 18R forming the hood sides, and all three are attached to the exterior collar back panel 18*c*, 18*d* and 18*e*R and 18*e*L. The outer wings of the collar panel 18*e*R, 18*e*L are unzipped to the opened position. Panel 34, forming the harness suspension strap channel, is shown in dashed lines as it is hidden in this view, but visible in FIG. 3.

Figure 2B:
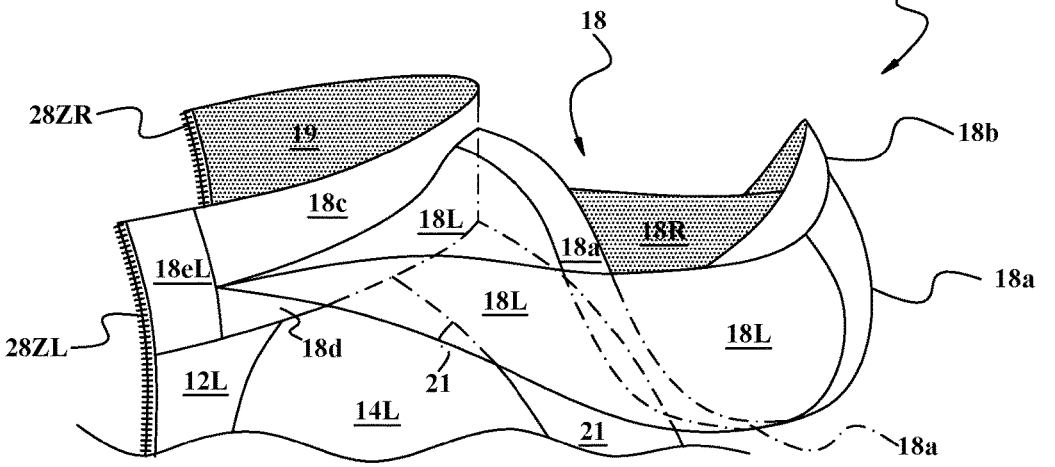
FIG. 2B is an isometric view from the rear left side showing the detail of the attachment of the hood to the shoulder yoke, front and sleeve panels.

FIG. 2B illustrates how the hood assembly 18 is secured to the collar which comprises an inner collar panel 19 and a pair of exterior collar panels 18*c* and 18*d*. The bottom of the hood side panels 18L and 18R and the hood back panel 18*a* are secured at the juncture of 18*c* and 18*d*. This puts an exterior surface of the collar above the bottom of the hood so that the wearer's neck is protected. Exterior end finisher panels 18*e*L and 18*e*R (also seen in FIG. 2A) complete the outside of the collar so that the outer edges mate with the ends of the collar inner panel 19 and the front zipper 28ZL/28ZR. The bill/visor 18*b* of the hood assembly 18 is shown secured to and bridging the forward end of the side and back panels 18L, 18R and 18*a*.

FIG. 3 is a front elevation view of the interior of the inventive garment 10 opened and lying flat showing the cooperating panels; this is the obverse of the FIG. 2A view, and the panels are correspondingly numbered. The cinching cords 31L, 31R are contained in respective channels 30L and 30R. The two hip pockets 26P are shown on each of panels 12L and 12R. A chest pocket 20P that is accessible from the front side zipper 20Z, see FIG. 1A, is shown in place on front panel 12L. On right front panel 12R, a chest pocket 42P is provided that is accessible from the interior of the garment 10 via zipper 42Z.

Figure 7:
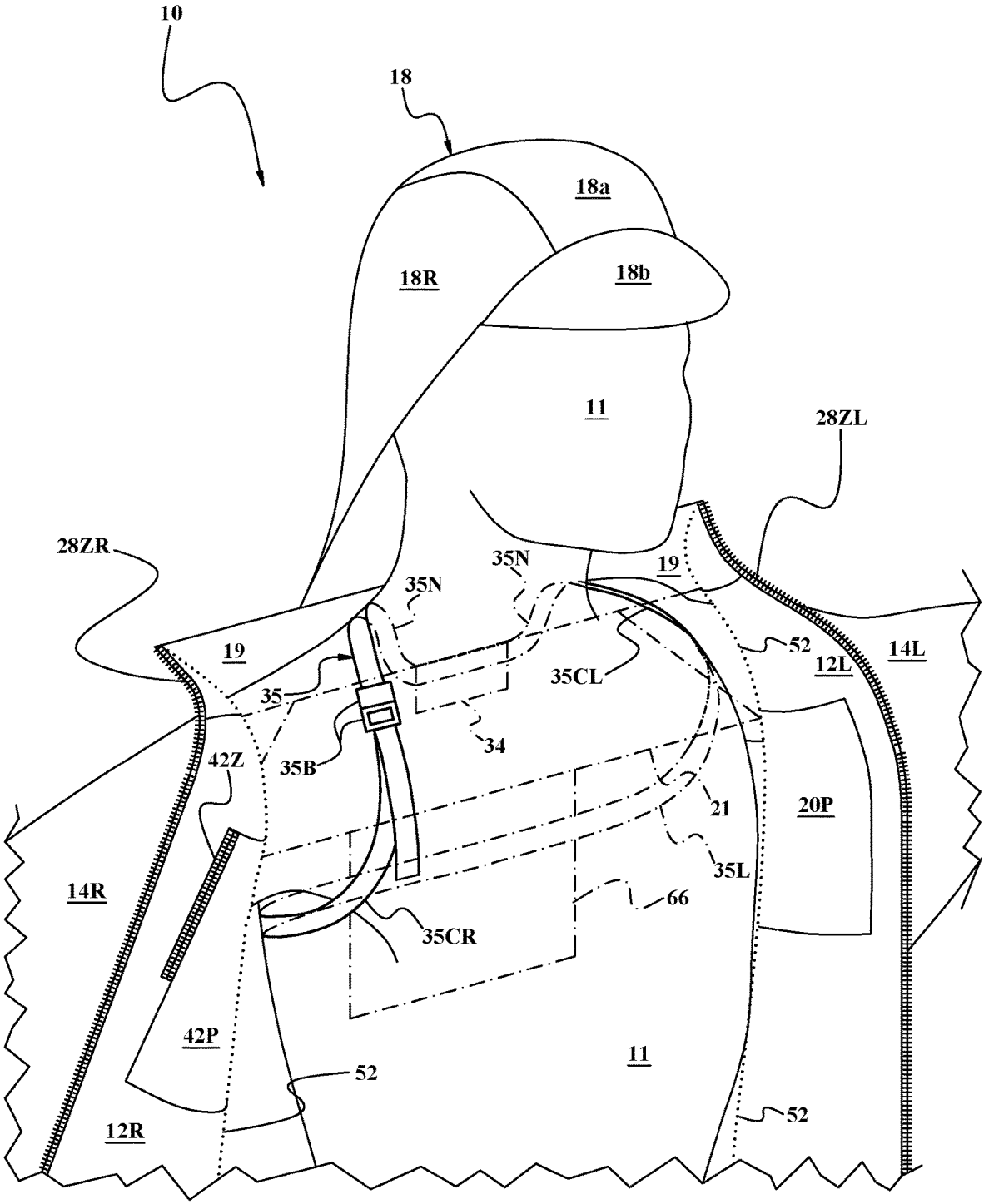
FIG. 7 is an enlarged front isometric view of the inventive garment in the configuration of use as put on by a user and secured by the garment harness suspension strap, in which the front is open (unzipped) and the hood has been deployed to cover the user's head; in this configuration the user is not wearing a backpack.
Figure 13:
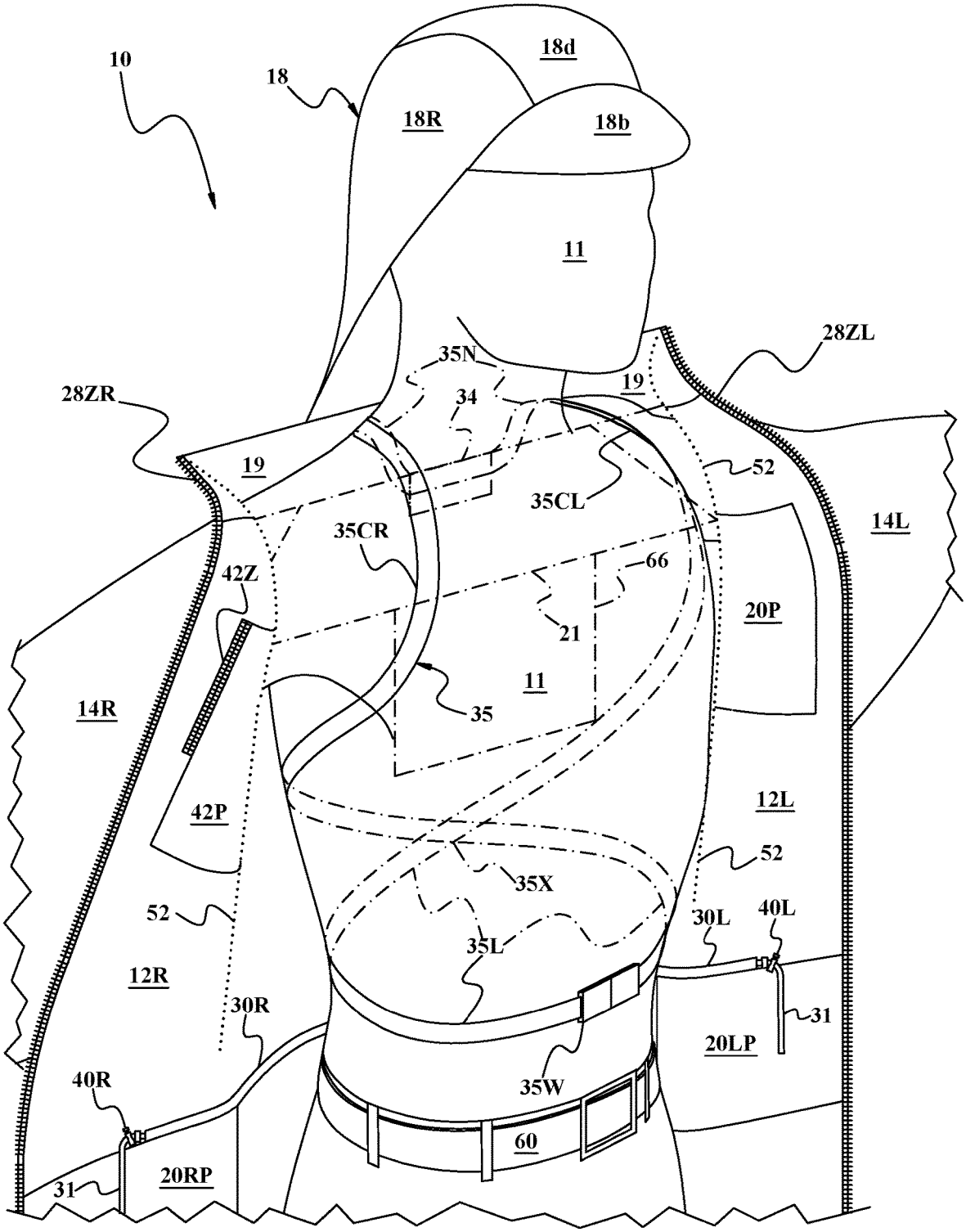
FIG. 13 is a front isometric view with the garment open to show an alternate suspension strap system that places the closure buckle at the user's abdomen front.

The configuration of the suspension strap and way in which a hiker puts on the harness is an important feature of the invention. The suspension strap 35 is shown in a first embodiment threaded through the channel 34 secured to shoulder yoke panel 21. The strap includes a buckle 35B; since the strap 35 is not secured to the channel piece 34 but rather passes through and is retained by channel 34, it is free to move laterally, so the buckle can be positioned in a comfortable position for the wearer, here shown by example, at the right clavicle area of the wearer. As best seen in FIG. 7, the back loop portion 35L of the suspension strap 35 is positioned along the hiker's back, at approximately shoulder blade level, while the ascending chest portions of the suspension strap 35C come under the arms and around behind the neck as shown by portions 35N. Thus, the suspension strap 35 loops around behind the hiker from behind the neck, down the chest, under the arms, and across the back, so that the suspension strap will not be pulled back by the weight of the cloak/jacket or a backpack. This is in contrast to some conventional cloak/jackets, in which a strap goes across the front of the neck, as a result of which the strap rides up to choke the hiker. That conventional construction is unsafe, for example, if the cloak/jacket gets snagged and the hiker slips and falls forward. This is a single loop embodiment of the suspension strap; a double loop embodiment is shown in FIG. 13.

Figure 11:
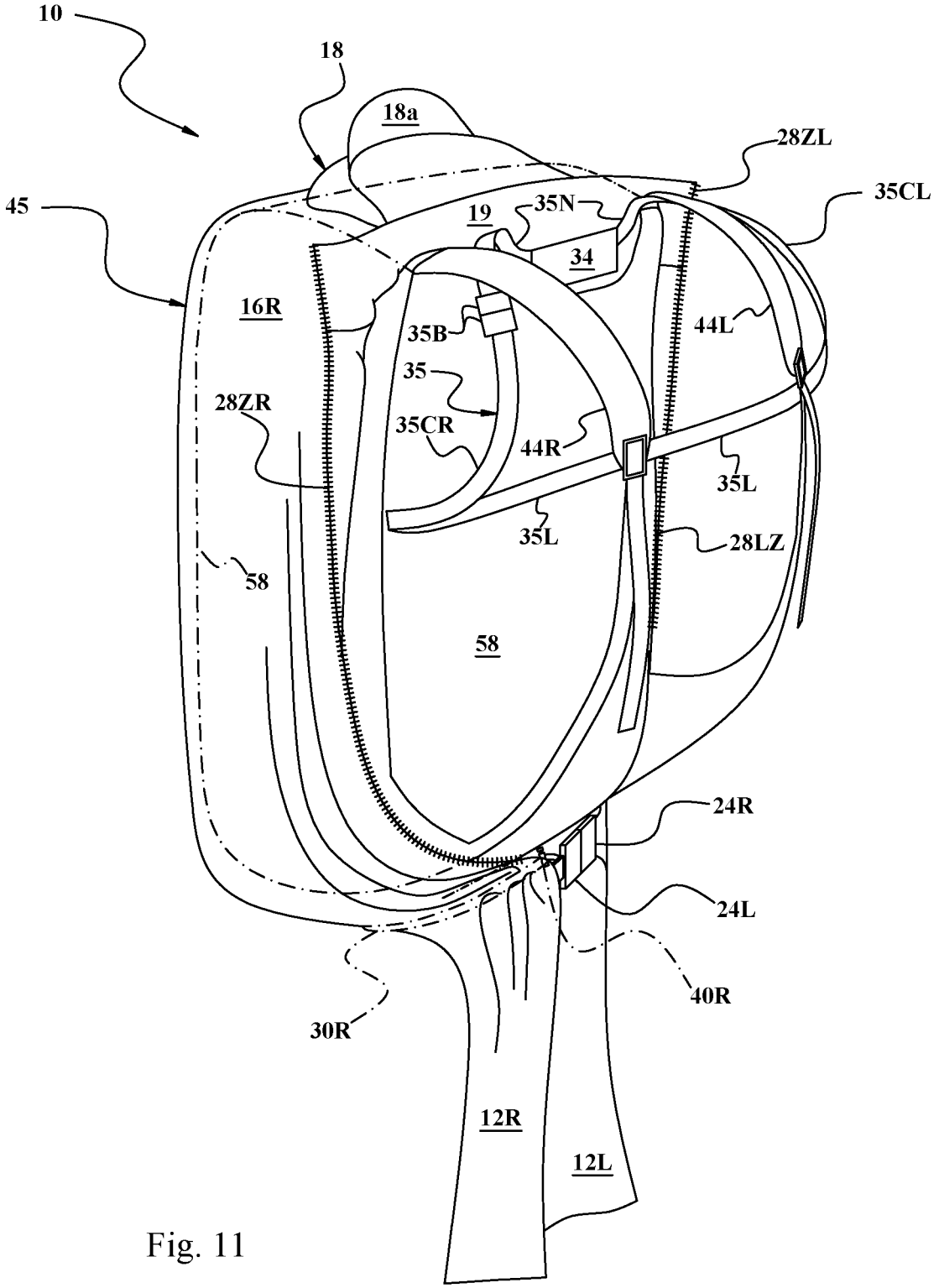
FIG. 11 is an isometric view from the front right side, as compared to FIG. 8 the user is not shown, in which the hood is doffed and showing details of the cinching of the waist drawcord of the garment and the gathering belt is buckled behind the back of the user, to retain the lower portion of the garment in a gathered configuration.

FIG. 4 is a rear elevation view of the inventive garment 10, opened and lying flat with the several panels numbered and showing the backpack cover panel 38 fully deployed. By unzipping the zippers 36LZ and 36RZ from the zipper 36 across the bottom of yoke panel 21, the side panels 16L, 16R can move laterally to the side (expand outwardly), and the cover panel 38 moves rearwardly, forming the cover or pouch 45 that covers a back pack. The fold line 52 is indicated as the approximate apex of the fold at the top rear of the backpack. The cinch cord (not shown, see 31 in FIG. 3) is exposed in the back and enters channels 30L and 30R in the side panels 16L, 16R and continues to approximately two-thirds of the lateral width of the front panels 12L, 12R. As best seen in FIG. 11, the buckles 24L, 24R are engaged behind the hiker after cinching the cord 31 under the backpack, the front and side panels 12L, 12R and sleeves 14L, 14R are gathered behind the hiker, and then those buckles engaged to secure the garment on the back of the wearer without the side and front panels forming a "balloon" skirt that hinders hiking or trekking.

Figure 10A:
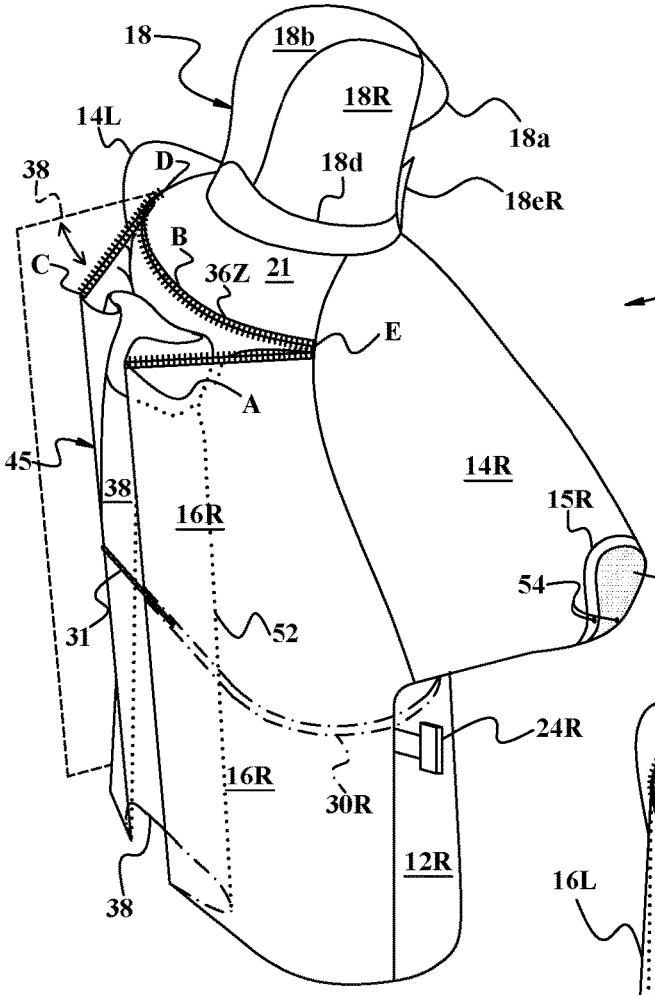
Figure 10B:
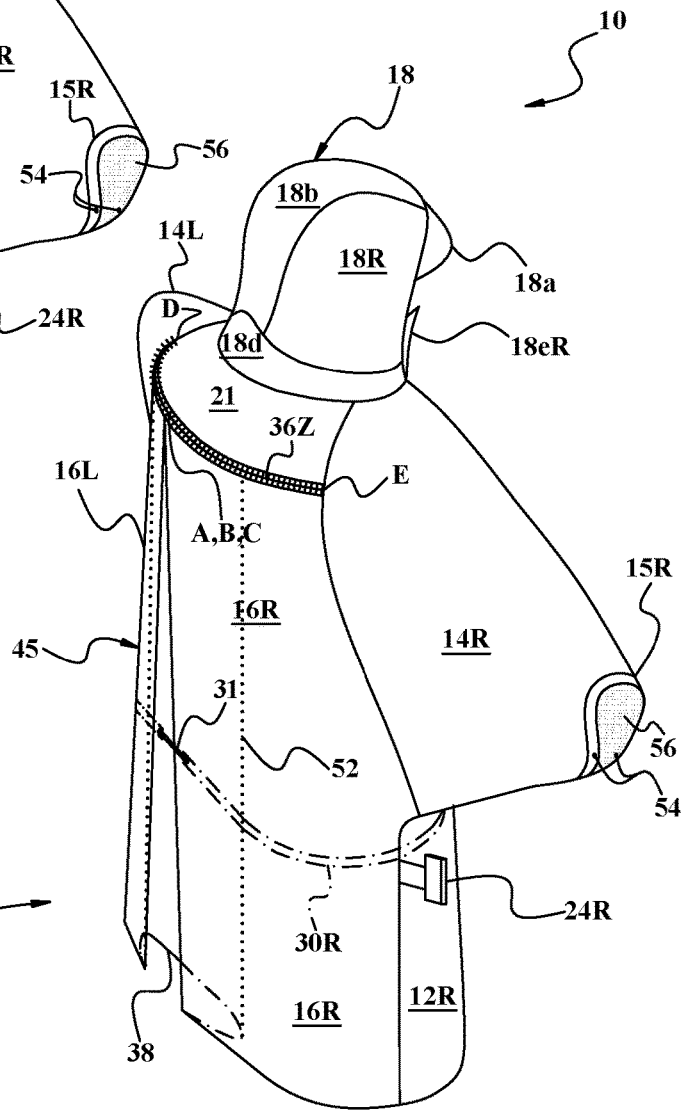

FIG. 5 is an exploded plan view of the several individual panels of the inventive cloak/jacket 10 as seen from the exterior side laid out flat in an assembly layout to show how they cooperatingly fit together to make up the cloak/jacket. The standard marginal lettered notches "Δ" are used to show which panel margins mate with the adjacent panels in the construction layout FIG. 5. Thus, facing margins with a lettered notch, e.g., Δa, mate with and are seamed with a matching lettered notch Δa on an adjacent panel. The notch system is straight forward. As best seen in FIGS. 10A and 10B, the backpack pouch zipper end points are identified by the capital letters A-E. Panel 66 forms a storage pouch for the suspension strap 35, as seen in FIGS. 7, 8, 12, 13 and 14.

Figures 6A, 6B, 6C:
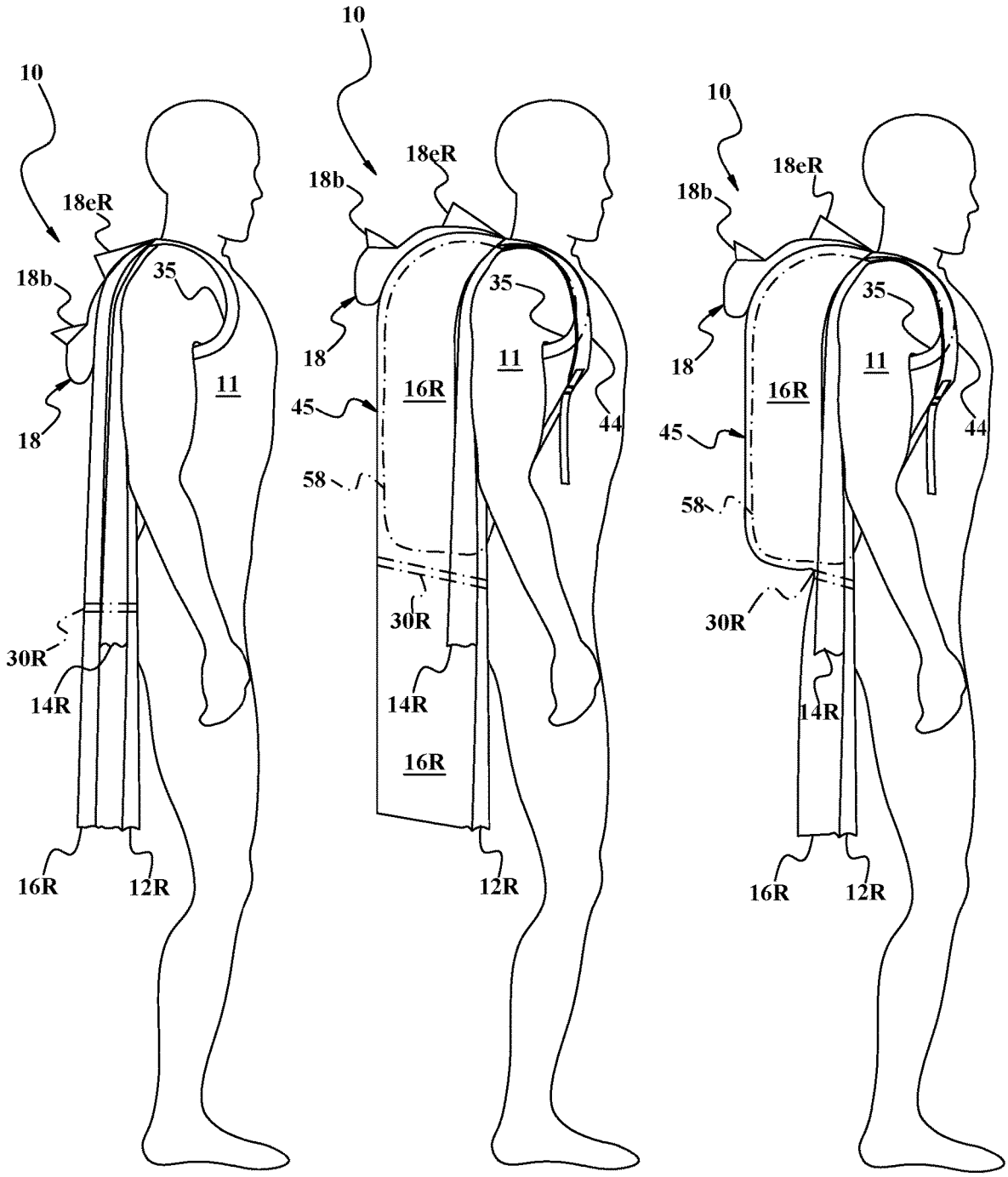

FIGS. 6A-6C are a series of side elevation views of the inventive garment 10 in its several modes of use as worn by hiker/trekker 11. FIG. 6A shows the garment 10 fully furled and carried on the back of a user during fair weather conditions. Note the arms and chest of the user 11 are exposed. FIG. 6B shows the garment backpack main compartment 45 (also called a backpack cover or pouch) deployed over a backpack 58 being carried by the user 11 which is secured by shoulder straps 44. To not overcomplicate the drawing, standard waist and chest straps of the backpack are not shown. In this configuration, the garment 10 is not unfurled or opened to cover the user's shoulders and chest. FIG. 6C shows the configuration of FIG. 6B in which the backpack pouch 45 is cinched below the bottom of the backpack 58 by draw-cord 31 in channel 30 to gather the material, thereby reducing the size of the garment "tail". As best seen in FIG. 11, the gathering buckles 24 are buckled outside, behind the hiker 11 and just below the backpack 58.

FIG. 7 is an enlarged front isometric view of the inventive garment 10 in the configuration of use as put on by a user 11 and secured by the garment suspension strap assembly 35-35N, in which the front panels 12L, 12R are unzipped (open) and the hood assembly 18 has been deployed to cover the user's head; in this configuration the user is not wearing a backpack. Note the suspension strap is configured as a single loop that goes behind the back 35L and the neck 35N, and loops under the armpits and up around the chest on both sides 35CL and 35CR. Since the strap 35 is free to move in the channel 34, the buckle 35B may be slid to be positioned anywhere most comfortable to the user, here shown at the right clavicle level. In an alternate embodiment, short straps with buckles on each end may be used, rather than a single continuous strap.

Figure 8:
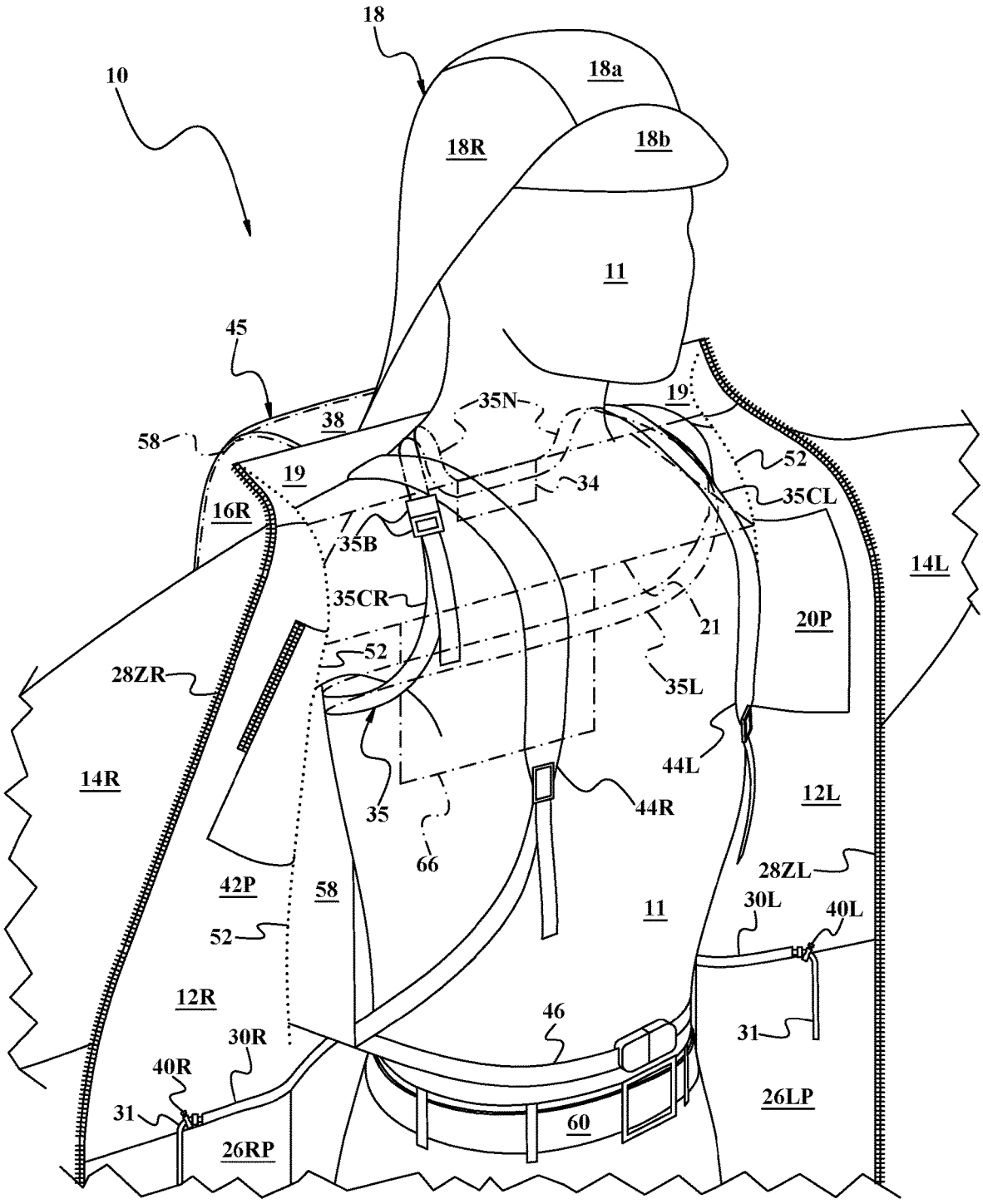
FIG. 8 is an enlarged front isometric view of the inventive configuration as shown in FIG. 7; in this configuration the user is wearing a backpack which can be donned and doffed independent of the garment.

FIG. 8 is an enlarged front isometric view of the inventive configuration of the garment 10 as shown in FIG. 7, but in this case the user 11 is wearing a backpack 58 which is mountable and removable independent of the garment. Note the backpack shoulder straps 44R, 44L go over the chest loops 35CR, 35CL of the garment suspension harness strap 35. The backpack hip belt 46 can be closed at the front of the user 11 without interfering with the user's trousers belt 60. Note, that were the backpack shoulder strap 44R to interfere with the suspension harness buckle 35B, that buckle can be moved down (or back) so that the backpack strap does not ride on it. Backpacks ordinarily have a pair of interlocking chest straps that link the two shoulder straps 44R, 44L across the chest at about the sternum level; however these are not shown for clarity.

Figures 9A, 9B:
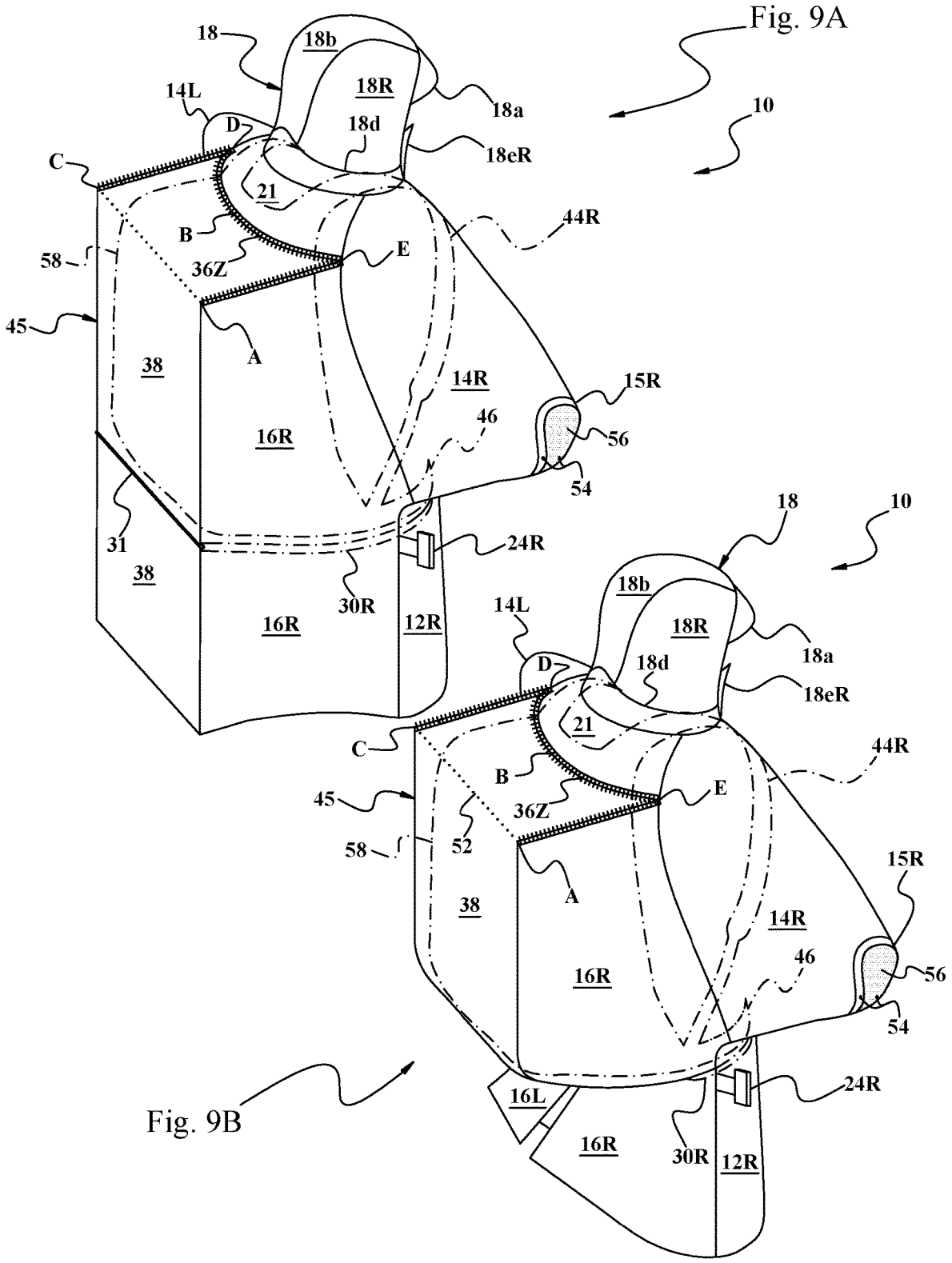

FIGS. 9A and 9B are rear right side isometric views showing the inventive garment 10 in the fully deployed use configuration for hiking or trekking in inclement weather with the hood assembly 18 covering the user's head. FIG. 9A shows the backpack pouch assembly 45 initially unfurled and deployed to cover a backpack 58. Note the segments A-E and C-D of top zipper 36Z have been unzipped so that the outer back panels 16R, 16L, are extended backwards and the inner panel 38 now becomes the top and back cover over the backpack. The zipper 36Z has been unzipped in two segments. Segments A-E-B are the right side segment half of the zipper, and segments C-D-B are the left side segment. A zips to B, and C zips to B, in the closed position.

Note the draw-cord 31 is exposed across the back at approximately the bottom of the backpack, e.g., at the waist line. The right side backpack chest strap is shown at 44R across the chest of the user. FIG. 9B shows the lower portion of the backpack pouch 45 below the waist line has been cinched by the cord 31 (of FIG. 9A), under the bottom of the backpack for hiking in inclement weather. Note that there is no large open area below the backpack. Rather the garment 10 is neatly gathered in back to prevent billowing of the rear of the cloak/jacket. This also conserves heat in cold weather.

FIGS. 10A and 10B are right side isometric views of the inventive garment 10 from the same perspective as FIGS. 9A, 9B showing the transition of the backpack pouch 45, after the user has removed the backpack from under the cloak/jacket while still wearing it, from the partially open position to the closed position by folding in the pouch cover panel 38, folding over the outer back panels 16R, 16L by pulling on the draw-cord 31, and rezipping the zipper 36Z segments AE to BE and CD to DB. FIG. 10A shows the top zipper 36Z unzipped to release the infolded backpack pouch cover panel 38 (or the reverse, the tucking-in of the panel 38 in preparation to closure of the zippers AE and CD to EB and DB, respectively). FIG. 10B shows the backpack cover pouch completely stowed and the top zipper 36Z segments zipped closed.

FIG. 11 is an isometric view from the front right side of the cloak/jacket 10 opened along front zipper 28RZ, 28LZ and gathered in back under the backpack 58. As compared to FIG. 8, however, the user is not shown. The hood assembly 18 is doffed back to rest on the top of the backpack 58. This figure shows the details of the cinching of the waist draw-cord 31 (in channels 30R, 30L) and the short gathering buckles 24R, 24L buckled behind the back of the user below the backpack, to retain the lower portion of the garment in a gathered configuration below the backpack. As best seen in FIGS. 9*a*, 9*b*, 10*a* and 10*b* the webbing of the gathering buckles is sewn into the seam joining the front and back panels 12L, 12R and 16L, 16R, respectively.

Figure 12:
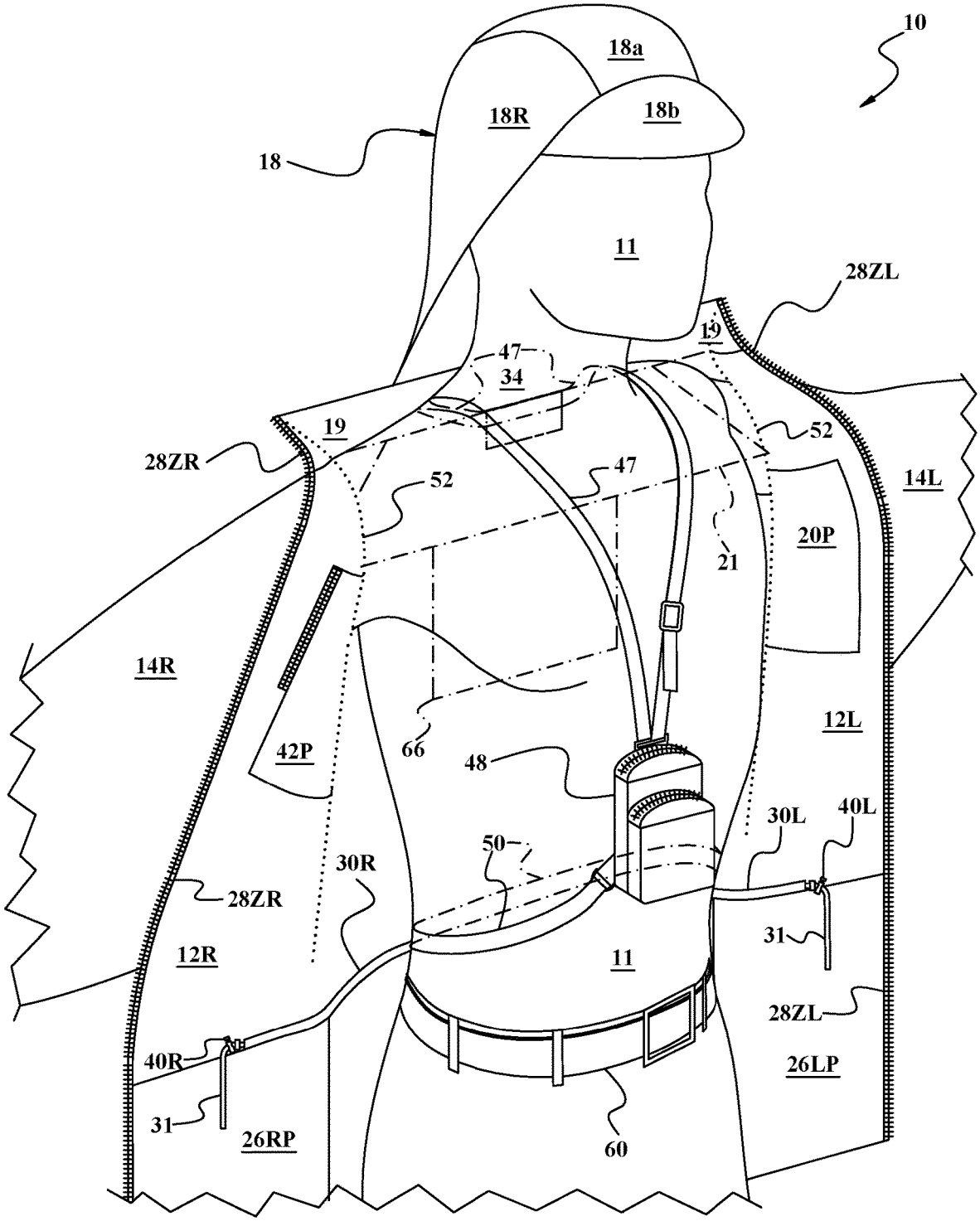
FIG. 12 is a front isometric view showing an alternate embodiment of a harness for retaining the inventive garment on a user, in this version using a neck and waist strap connected to a chest pouch or sternum plate.

FIG. 12 is a front isometric view showing an alternate, 2-strap suspension harness embodiment for retaining the inventive garment 10 on a user 11, in this version using separate neck and waist straps 47, 50 connected to a chest pouch or pouches assembly 48 or sternum plate, such as a generally triangular sternum plate. As in the harness embodiment shown above in FIGS. 1-11, the strap 47 routes behind the neck through the suspension strap channel 34, over the shoulders to the front, and down the chest. A separate waist strap 50 loops around behind the torso and engages the bottom of the chest pouch 40 or sternum plate in the front. The waist strap 50 is similar to the under-arm chest strap 35CR, 35CL shown in FIG. 8. Likewise, this embodiment using 2 suspension straps does not choke the hiker.

An alternate embodiment of the suspension strap 35 configured in a double loop is shown in FIG. 13. As in FIG. 6A, and FIG. 7, the suspension strap 35N is routed over the top of the shoulders on each side of the neck toward the front of the wearer, down the outer portion of the pectorals and under the arms toward the back, 35CR and 35CL. However, note there is no adjustment buckle 35B (see FIG. 7) at the clavicle. Rather, the suspension strap 35 extends criss-cross, 35X, as shown, across the back of the wearer, then brought forward to be wrapped around the waist in the front where it is closed with an adjustment buckle 35W.

In this embodiment, the suspension strap is lengthened and includes two opposed ends, the ends having corresponding mating male and female fittings. The strap in the use position is configured to pass through the back yoke suspension strap channel 34, with strap portions intermediate the ends passing over both shoulders of the wearer, down across the pectoral/axilla margin of the upper chest, under the armpits to criss-cross in the thoracic/lumbar region of the lower back, and thence around front to the abdominal region, wherein the strap end fittings cooperate as a length-adjustable and releasably-engagable buckle assembly 35W. The suspension strap may be stowed in pouch 66 when not in use; see also FIGS. 7, 8, and 12.

Figure 14A:
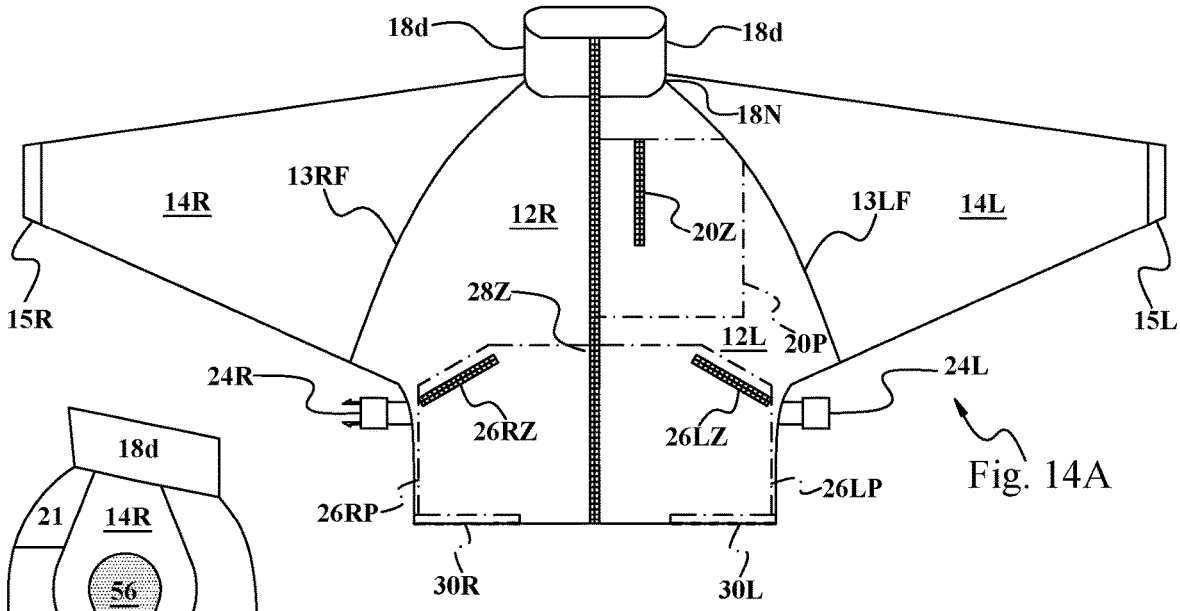
Figure 14B:
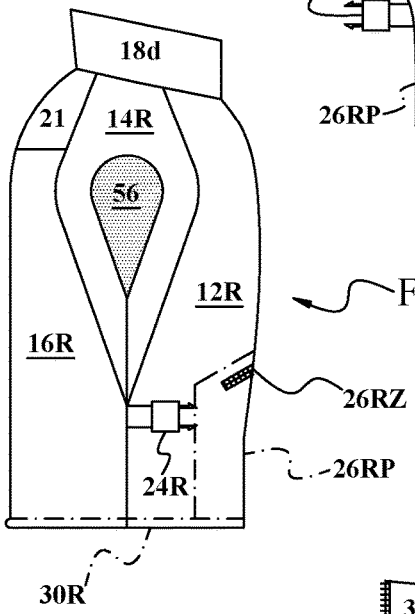
Figure 14C:
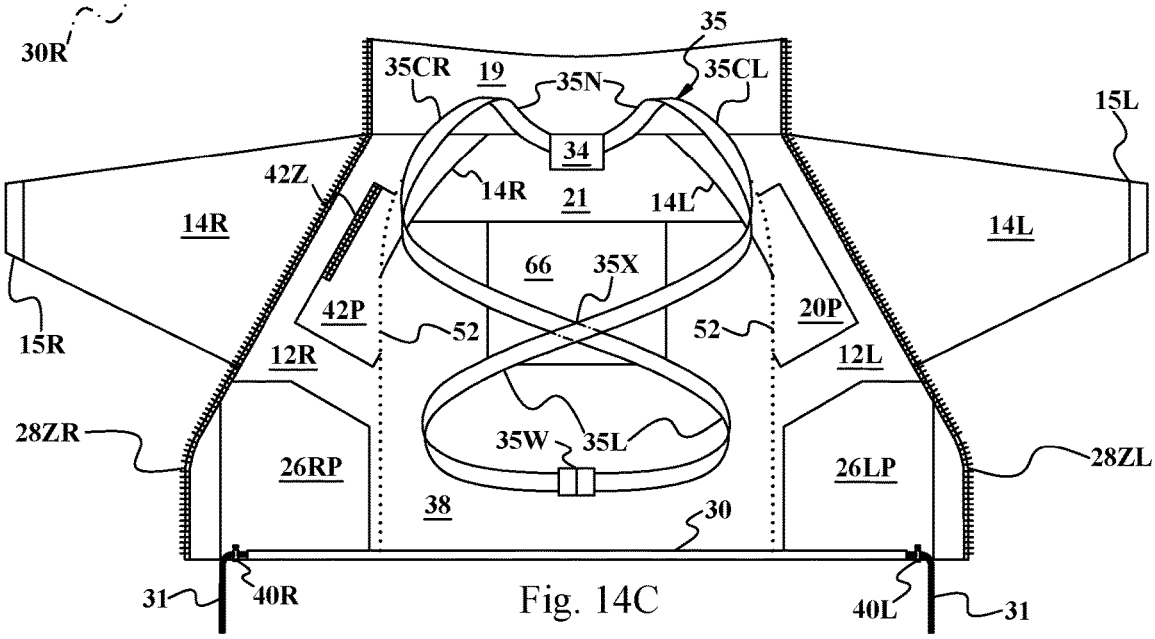
FIG. 14C is a view of the jacket of FIGS. 14A, B open to show the suspension strap system of FIG. 13 and the internally accessible pocket(s) and draw string.

FIGS. 14A, 14B and 14C are a series of figures showing the principles of the invention applied to a jacket length garment which uses the suspension strap system of FIG. 13, as seen in FIG. 14C. The garment panels are as in FIG. 5. In this embodiment, note that, as compared to FIGS. 1-6, the garment sides 12, 16 do not extend substantially below the waist cord draw channel 30. However, it should be understood that an elastic cuff (not shown) can be attached at the bottom of the panels 12, 16, 38 as an alternative to, or in addition to the waist cord 31 and its channel 30. Thus, this embodiment utilizes the floating suspension strap and channel 34, 35 as in FIG. 13. Although a hood is not shown, it should be understood that a hood 18 as shown in FIGS. 1-5, 7-10 and 13 may be included as part of this jacket configuration. In this embodiment, although no back pack pouch and cover panels (see FIGS. 1B, 1C, 2A and 3-6) are shown, they may be included as described above for the full length cloak-type garment. The pouch may be smaller to accommodate a small, day-pack. The jacket configuration includes the batwing sleeves for ease of donning and doffing from the transport position. Although no vent zippers in the chest or armpits are shown in this embodiment, they may be selectively included. FIG. 14C shows the stowage pouch 66 for the suspension strap 35.

In another embodiment, the jacket of FIG. 14A-C may be configured as a warm-up jacket which includes a light-weight insulating layer with low to moderate water and wind resistance, such as soft-shell or fleece material. It can be carried on the user's back as described above (see, e.g., FIG. 6) and worn during the beginning of physical activity or during low physical activity periods.

Figure 15:
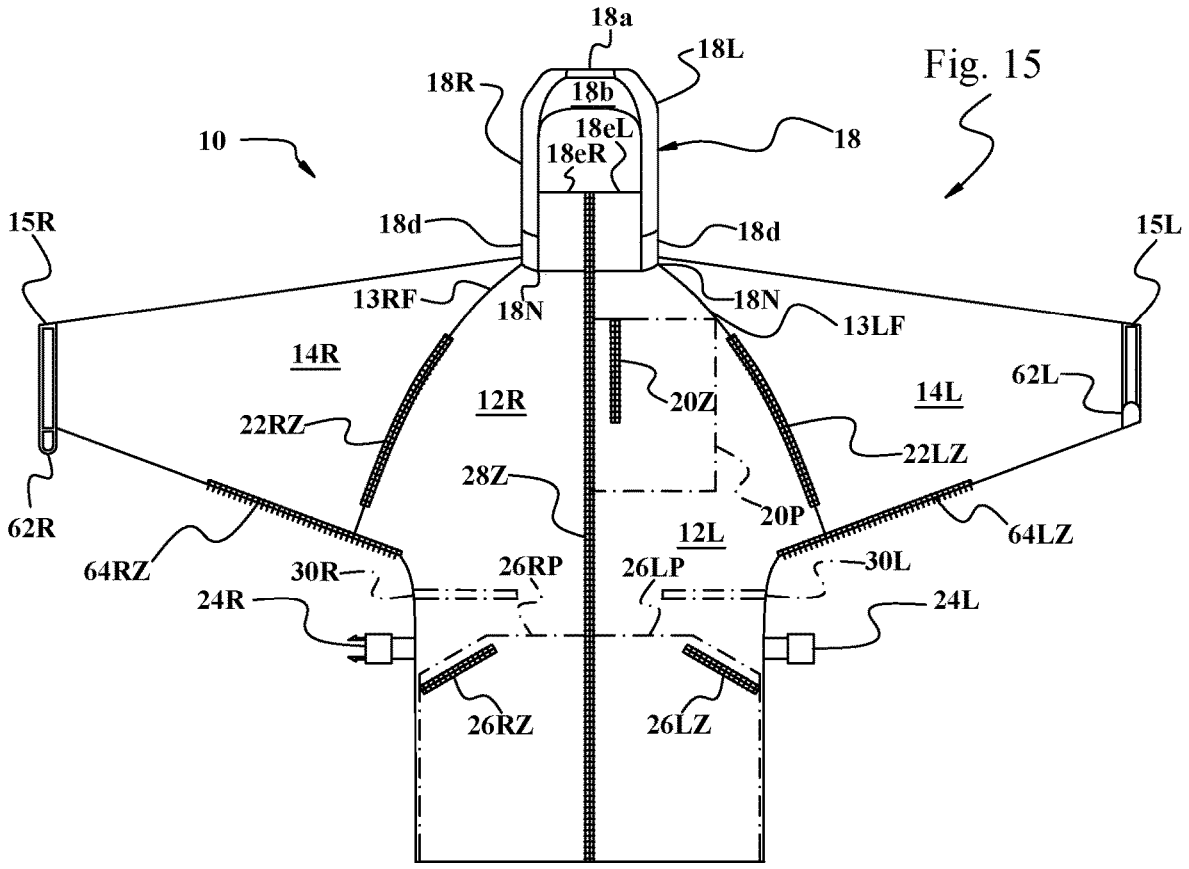
FIG. 15 is a front elevation view of an alternate embodiment of the garment in which vent zipper-openings are provided at the bottom of the sleeves (the armpit location), in addition to, or as an alternative to the chest-side located vents (also shown).

FIG. 15 shows another embodiment of the garment in which waterproof armpit vent zippers 64LZ and 64RZ connect panels 12L/14L and 12R/14R respectively, beginning about half-way along the forearm and extending back to the armpit. Chest side vents 22LZ and 22RZ are shown. These vents function as described above in connection with FIG. 1A. One or both pairs of vents may be incorporated in the garment. In addition, the closures for the wrist cuffs 15L and 15R are shown as Velcro-type hook and loop straps, the right side 62R being shown opened, and the left side 62L being shown closed.

In still another embodiment, both a warm-up jacket and cloak can be worn simultaneously, in which configuration slots are provided behind the neck channel of the warm-up jacket (not shown) through which the cloak suspension strap may be fed in order to support both the cloak and warm-up jacket simultaneously.

INDUSTRIAL APPLICABILITY

It is clear that the inventive garment of this application has wide applicability to the inclement weather gear industry, for example, active wear, outdoor and hiking outfitters for back country activities. The inventive garment is clearly universal and accommodating, and has significant and substantial features for donning and doffing backpacks independent of the garment, and the ability to gather the garment while wearing it so that the hiker can move unencumbered while still having the garment instantly at hand. Thus, the inventive universal multi-mode garment has the clear potential of becoming adopted as the new standard for inclement weather coverage garments.

It should be understood that various modifications within the scope of this invention can be made by one of ordinary skill in the art without departing from the spirit thereof and without undue experimentation. For example, the several panels can have a wide range of designs to provide the functionalities disclosed herein. Likewise the harness may be constructed in a wide range of configurations, and vent locations varied as needed. This invention is therefore to be defined by the scope of the appended claims as broadly as the prior art will permit, and in view of the specification if need be, including a full range of current and future equivalents thereof.

The invention claimed is:

1. A multi-mode garment for a human wearer, said garment having a garment shoulder harness assembly and bat-wing type sleeves, said garment comprising a plurality of individual panels assembled and attached to each other to form an integral structure which, when worn in a deployed mode, selectively covers both said wearer and a backpack worn by said wearer, and said garment and said backpack may be donned or doffed by said wearer independent of each other, including donning said backpack after said garment is donned by said wearer, said independent donning and doffing being facilitated by said bat-wing sleeves and harness, and without assistance of another person, and said garment, after donning by said wearer, may be partially doffed by said wearer into a gathered transport mode retained by said harness on said wearer's back for rapid deployment to a fully unfurled configuration to cover said wearer and said backpack in case of change in weather conditions, and wherein said garment includes a collar panel secured to a shoulder yoke panel, said shoulder yoke panel includes a panel forming a channel, said shoulder harness assembly includes a continuous suspension strap received through said channel from which suspension strap said garment is suspended, said suspension strap is mountable on the shoulders of the the body of said wearer, and said suspension strap supports said garment while partially doffed and carried on the back of the wearer in a transport mode to prevent said garment from riding up and back in the front, so that said garment does not choke said wearer.

2. The multi-mode garment as in claim 1 in which said plurality of individual panels includes expandable backpack cover panels permitting donning or doffing a backpack by said wearer alone without assistance and independent of said garment, even while said garment is deployed in a fully unfurled inclement weather use configuration thereby covering said backpack by said garment in its fully unfurled configuration.

3. The multi-mode garment as in claim 2 wherein said plurality of individual panels are assembled so that said garment can be independently put on or taken off without disturbing said backpack worn by a wearer and without assistance of another person.

4. The multi-mode garment as in claim 2 which includes a back panel to which said expandable backpack cover panels are secured, said back panel includes a draw cord secured in a channel, and said draw cord permitting cinching said backpack back and cover panels over said backpack when said garment is donned by a wearer.

5. The multi-mode garment as in claim 4 wherein said expandable back pack cover panels of said garment are releasably secured to each other by closures which permit said panels to be released from each other to form with said back panel a pouch to cover a back pack worn by the garment user.

6. The multi-mode garment as in claim 3 wherein said plurality of individual panels includes front panels, one left panel and one right panel, each of said left and right panels includes a closable vent opening, said vent openings being positioned to permit said wearer to vent excess heat without doffing said garment.

7. The multi-mode garment as in claim 3 wherein said garment includes a pair of closable vent openings disposed adjacent the armpits of said users, said vent openings being positioned to permit said wearer to vent excess heat without doffing said garment.

8. The multi-mode garment as in claim 3 wherein said garment includes at least one pair of closable vent openings positioned to permit said wearer to vent excess heat without doffing said garment.

9. The multi-mode garment as in claim 6 wherein said vent openings are positioned at the margins of said front panels adjoining said bat wing sleeves.

10. The multi-mode garment as in claim 1 wherein said suspension strap is elongated, fitted through said channel, and includes two opposed ends, said ends having corresponding mating male and female fittings, said strap in said use position is configured to pass from the back yoke sleeve, strap portions intermediate said ends passing over both shoulders of the wearer, down across the pectoral/axilla margin of the upper chest, under the armpits to criss-cross in the lumbar region of the lower back, and thence around front to the abdominal region, wherein said strap end fittings cooperate as a length-adjustable and releasably-engagable buckle assembly.

11. The multi-mode garment as in claim 1 which includes a hood assembly.

12. The multi-mode garment as in claim 1 which includes a strap and buckle assembly to retain said garment in a gathered configuration on the back of the wearer.

13. The multi-mode garment as in claim 1 which includes front panels, one left panel and one right panel, said panels being selectively releasably closable by a closure structure.

14. The multi-mode garment as in claim 1 wherein the material of said garment is light-weight yet weather resistant.

15. The multi-mode garment as in claim 14 wherein said garment includes a plurality of pockets accessible from at least one of the interior and the exterior of the garment.

16. The multi-mode garment as in claim 1 wherein said sleeves terminate in cuffs forming openings for a user's wrists, and said cuffs include closures to adjust the size of said cuff openings.

17. The multi-mode garment as in claim 1 which includes front and back panels of a length extending down to the knees of a user to form a cloak.

18. The multi-mode garment as in claim 1 which includes front and back panels of length extending down to the waist of a user to form a jacket.

19. The multi-mode garment as in claim 1 wherein said garment includes front and back left and right panels to which said batwing sleeves are attached, said batwing sleeves include large entry openings for the wearer's arms to facilitate easy articulation of the wearer's arms into the sleeves upon release from a furled transport position on the wearer's back.

* * * * *